US005531173A

United States Patent [19]

Migliorini

[11] Patent Number: 5,531,173

[45] Date of Patent: Jul. 2, 1996

[54] APPARATUS FOR POSITIONING THE FOOT PORTION OF TUBULAR KNITTED ARTICLES

[75] Inventor: Pier L. Migliorini, Terranuova Bracciolini, Italy

[73] Assignee: Solis S.R.L., Tavarnuzze, Italy

[21] Appl. No.: 304,560

[22] Filed: Sep. 12, 1994

[30] Foreign Application Priority Data

Oct. 18, 1993 [IT] Italy ..... FI93A0207

[51] Int. Cl.[6] ..... D05B 39/00

[52] U.S. Cl. ..... 112/470.15

[58] Field of Search ..... 112/470.15, 470.08, 112/475.12, 2; 223/75

[56] References Cited

U.S. PATENT DOCUMENTS 4,383,491 5/1983 Hodges ..... 112/475.12 X
5,309,853 5/1994 Gazzarrini ..... 112/470.15

*Primary Examiner*—Peter Nerbun
*Attorney, Agent, or Firm*—McGlew and Tuttle

[57] ABSTRACT

An apparatus for positioning the foot portion of tubular knitted articles for each article includes, a hosiery support rotating about a longitudinal axis and one or more corresponding photocells for detecting one or more marks suitably inserted in the fabric of the article. The hosiery support is made up of two coaxial elements, with the free end of the element of the hosiery support being in correspondence with the stocking foot and being so shaped as to form a flaring element for the corresponding pad. The pad is coaxial to the hose and is connected to a driving member to drive the pad into rotation together with a corresponding stocking or hosiery portion. The pad is engaged to a corresponding cylinder actuator with a horizontal axis, to allow it to move close to and respectively away from the hosiery support. Mounted in the vicinity of the free end of each hosiery support is a rubber-coated presser roller idly rotatable about an axis parallel to the axis of hose and intended to compress the fabric of the stocking foot on the respective support during the rotation thereof.

10 Claims, 5 Drawing Sheets

APPARATUS FOR POSITIONING THE FOOT PORTION OF TUBULAR KNITTED ARTICLES

FIELD OF THE INVENTION

The object of the present invention is to provide an apparatus for positioning the foot portion of tubular knitted articles, especially hosiery, such as tubular stockings and pantyhose articles.

BACKGROUND OF THE INVENTION

Stockings are known as being manufactured starting from a tubular knit element having both ends opened, and one end, that is, the toe portion, being seamed at a later stage.

Also known is that, when the stockings are provided with shaped or reinforced heels, the seam line of the toe must take up a well defined position with respect to the heel, so as to allow the stocking to be properly put on. The same type of problem is also likely to occur whenever it is necessary to orient the tip of the garment with respect to a fixed reference thereof, such as the bodice of a pantyhose article.

To achieve the desired orientation of the article toe it is possible to operate, or move the stocking, manually or automatically.

As far as a manual procedure is concerned, though it is practicable, it is not compatible with current production requirements, especially when considering the time needed for the manual positioning of each article. This time is exceedingly longer than the time usually used for carrying out each seaming operation.

Known from the European patent No. 33039 is an apparatus for the automatic sewing of the toe of hosiery articles provided with a heel. This apparatus comprises means for placing the toe portion of each stocking at a predetermined position with respect to the relevant heel. This is achieved by rotating the foot portion of the stocking previously fitted on a relevant fixed hosiery support by means of a rubber-coated roller having its axis parallel to that of the hose. This roller is placed laterally on, and adheringly to, the hose in order to engage the stocking and allow it to slidingly rotate about the longitudinal axis of the support until a photocell detects a suitable mark or thread inserted within the fabric of the same stocking. This causes the stocking to be in a predetermined position with respect to the heel.

However, this known apparatus exhibits some drawbacks. One of the drawbacks is the fact that the drive of the stocking, due to the action directly exerted by the roller over the stocking fabric, may cause an excessive and improper stretching of the stitches, owing to the very elasticity of the fabric. This is especially true when the latter is of high fineness and causes the risk of lowering the quality of the finished product. Moreover, it is necessary to accurately adjust the pressure exerted by the roller on the stocking. This pressure varies according to the fabric fineness, as well as to how accurately to stretch in advance tile stocking on the support. If the pressure is not accurately adjusted, the positioning takes more time than necessary.

SUMMARY AND OBJECT OF THE INVENTION

The main object of the present invention is to overcome the above drawbacks.

This result has been achieved, according to the invention, by adopting the idea of providing an apparatus comprising, for each article to be positioned, a hosiery support rotating about its longitudinal axis, means for moving the hosiery support and one or more photocells for detecting one or more marks inserted within the article fabric. The hosiery support is made up of two coaxial elements the one in correspondence of the article foot portion having its free end connectable to a corresponding driving member able to drive it into rotation together with a corresponding hosiery portion. A presser roller, idly rotating about an axis parallel to the axis of the hose, is located on top of the free end of the hosiery support and is provided to have the article or hosiery properly adhere to the support during the rotation thereof.

The advantages deriving from the present invention lie essentially in that it is possible to locate with the maximum accuracy and rapidity the foot portion of any tubular article with respect to the toe-seaming means so as to have the same toe in a predetermined position relative to any other region of the article, such as the heel, in case of stockings with a heel, or the bodice, in case of pantyhose articles, without causing deformations in the fabric stitches and thus ensuring the best quality of the finished product even in the absence of a previous and accurate stretching thereof on the relevant support. The apparatus according to the invention is of easy manufacturing and reliable even after a prolonged duty time.

BRIEF DESCRIPTION OF THE DRAWINGS

These and further advantages and characteristics of the present invention will be better understood by anyone skilled in the field by a reading of the following description in conjunction with the accompanying drawings given as a practical example of the invention but not to be considered in a limitative sense, in which.

DETAILED DESCRIPTION OF THE PREFERRED EMBODIMENT

Figure 1:
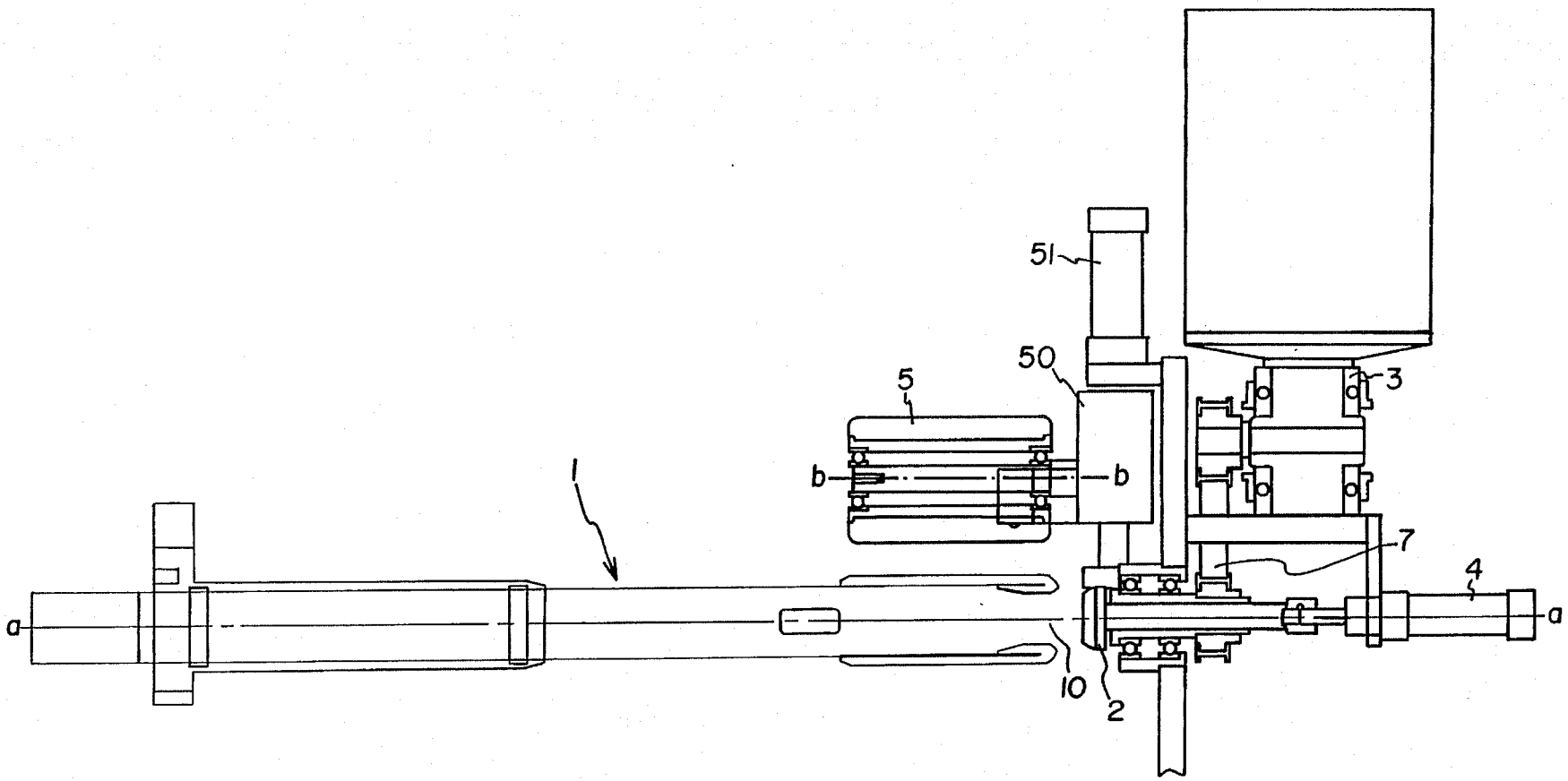
FIG. 1 is a longitudinal section view of an apparatus, according to the invention, in a standby position, showing a hosiery support, a hosiery-driving unit and respective presser roller with relevant actuation means.
Figure 2:
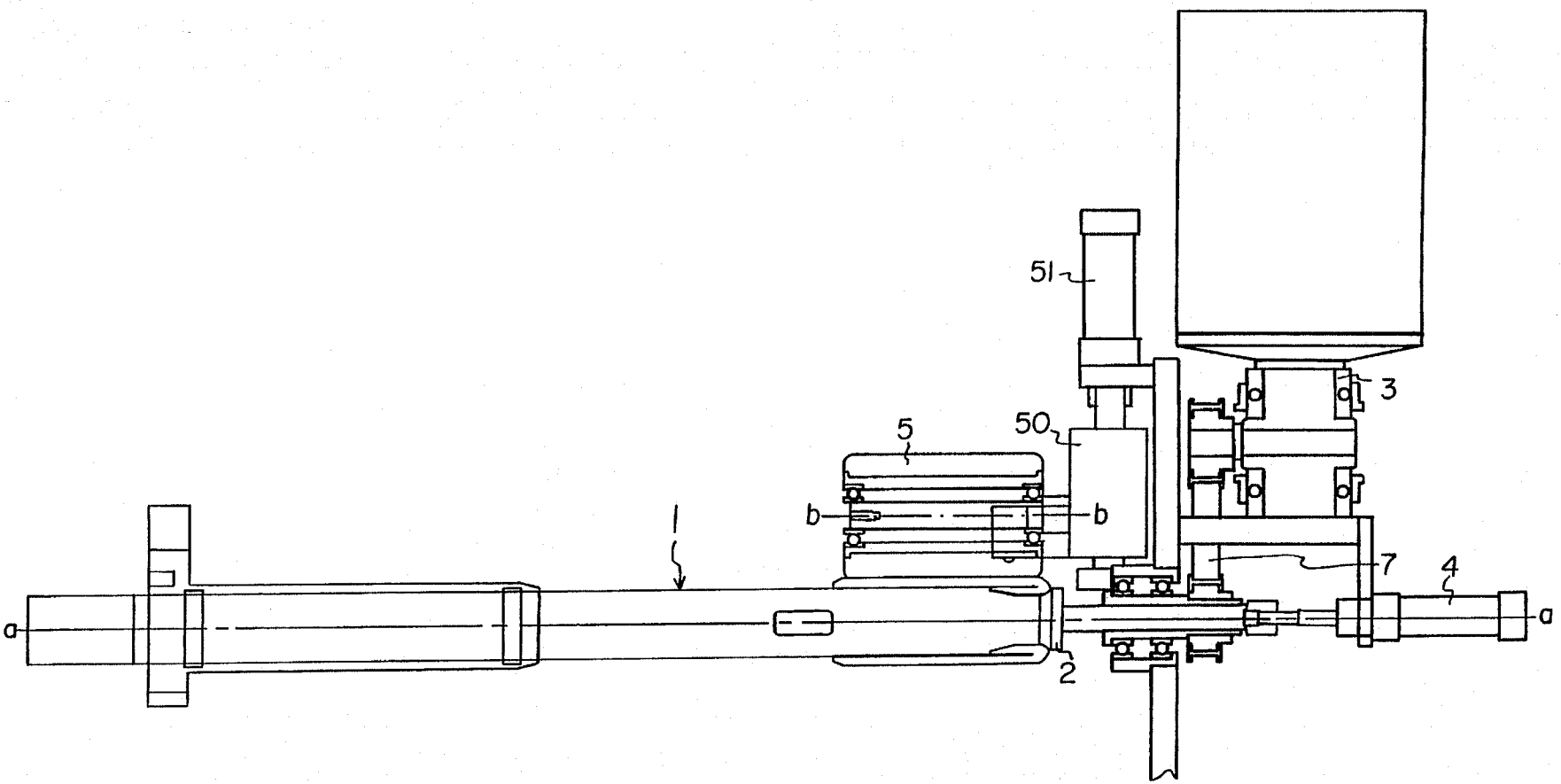
FIG. 2 shows the apparatus of FIG. 1 in operating condition.
Figure 2A:
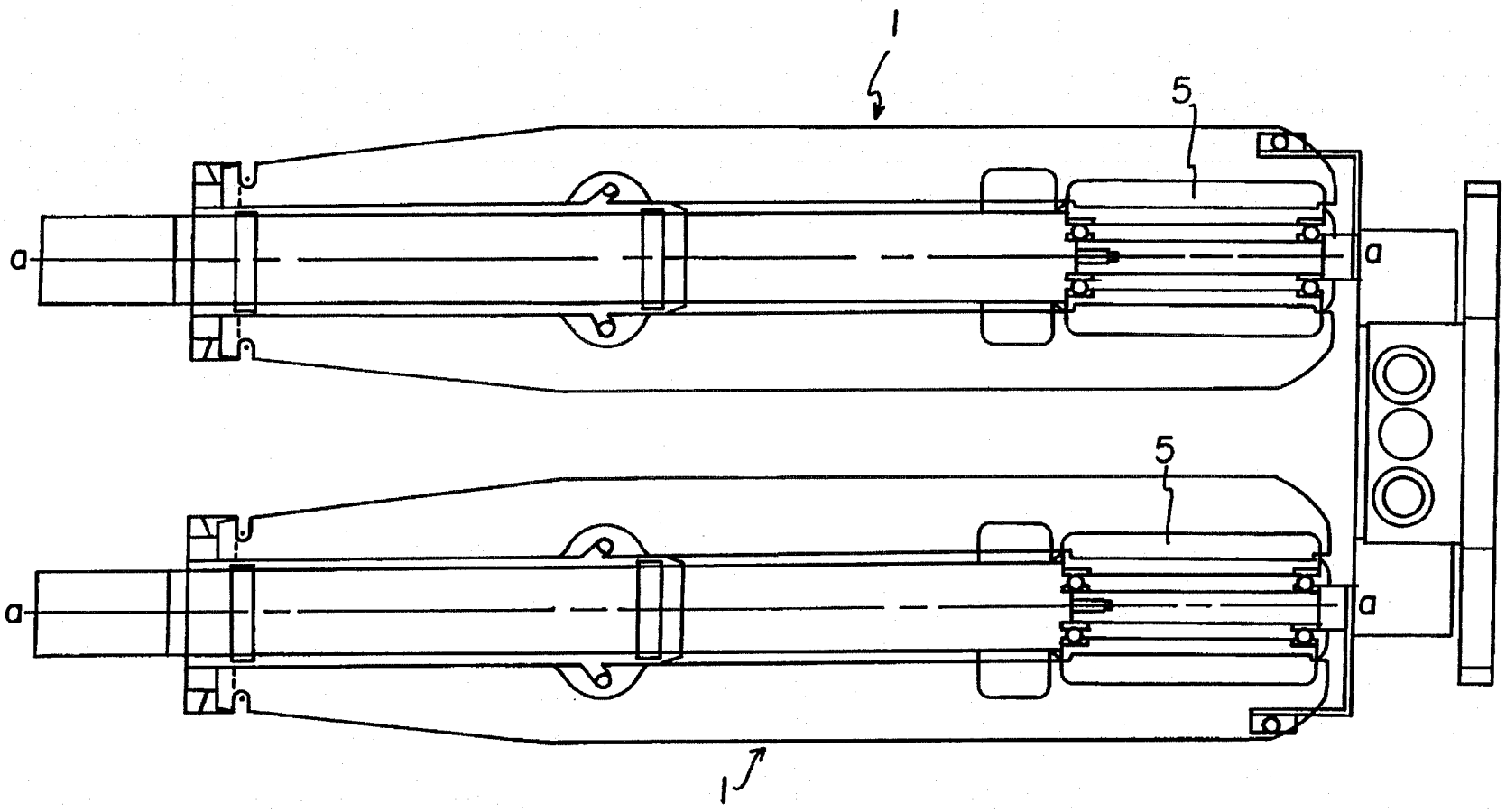
FIG. 2A is a plan view of an apparatus as in FIG. 2, for the positioning of the foot portion of the two stockings of a pantyhose article, showing the two stocking-supporting hoses and respective presser rollers.
Figure 2B:
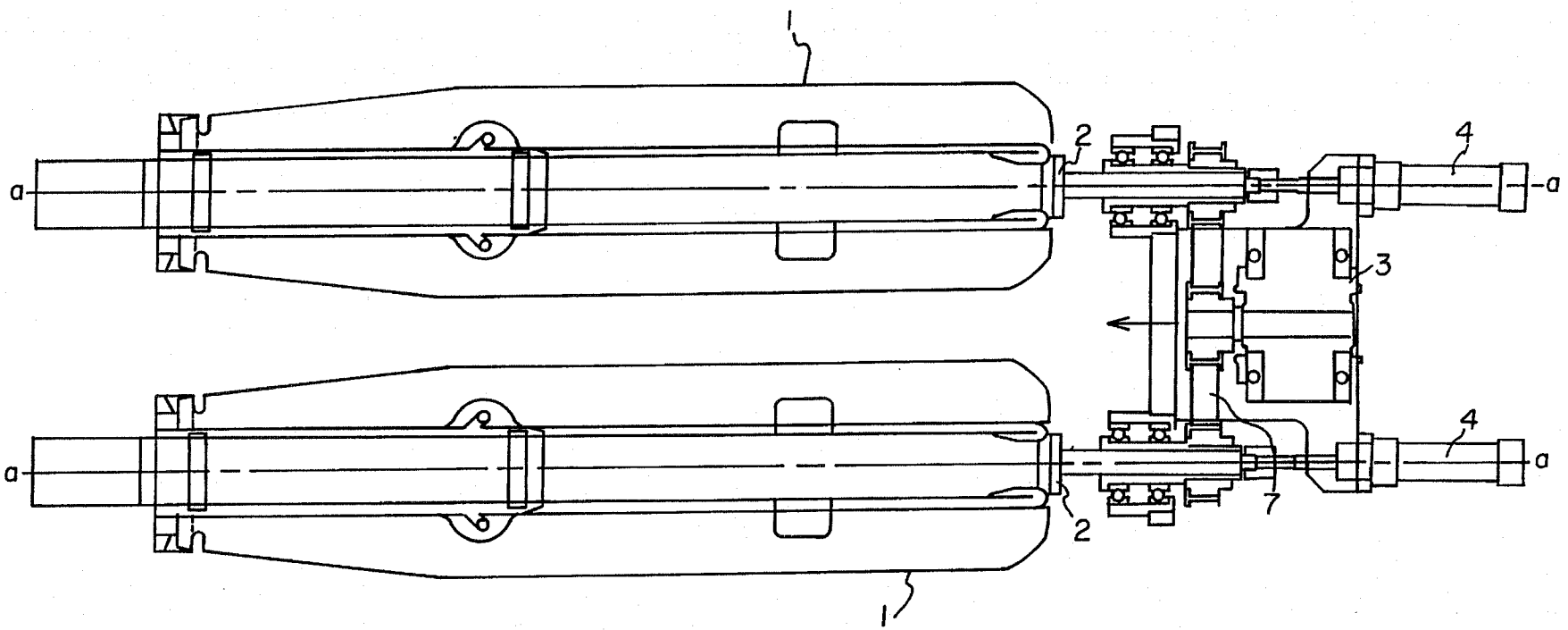
FIG. 2B is a view of the apparatus of FIG. 2A, showing the hosiery-driving means.

Reduced to its basic structure, and reference being made to the accompanying drawings, an apparatus for positioning the toe portion of the two stockings of a pantyhose article according to the invention includes for each stocking, a hosiery or stocking support 1 rotating about a longitudinal support axis a—a and made up of two coaxial elements. A free end 10 of the element of the support 1 is in correspondence with the foot of the stocking. The free end 10 is so shaped as to form a flaring element for a corresponding pad or coupling means 2 which is coaxial to the hosiery support 1. The pad 2 is connected to a driving member 3 for driving the pad 2 into rotation together with the corresponding stocking portion and the pad 2 is engaged to a corresponding cylinder actuator means 4 with a horizontal axis for allowing the pad to move close to and respectively away from the hosiery support 1. Mounted in the vicinity of the free end of each hosiery support 1 is a rubber-coated presser roller means 5 idly rotatable about a roller axis b—b parallel to the axis of hosiery support 1 and intended to compress the fabric of the stocking foot on the respective support 1 during the rotation thereof. The action thus exerted by each roller 5 on the respective stocking allows the maximum adhesion of the latter to the respective support hose 1. One or more photocells 6, used as detection means, are placed at a predetermined position with respect to a corresponding hosiery support 1 to allow the corresponding pad 2 to be controlled for its deactivation. The deactivation involves the moving away of the pad 2 from the support the moment a mark suitably inserted in the stocking fabric is detected. This is in accordance with techniques known per se to those skilled in the art. A plurality of the above mentioned marks may be inserted into a same stocking. The two rollers 5 are moved away when both the stockings are in the desired position.

Figure 3:
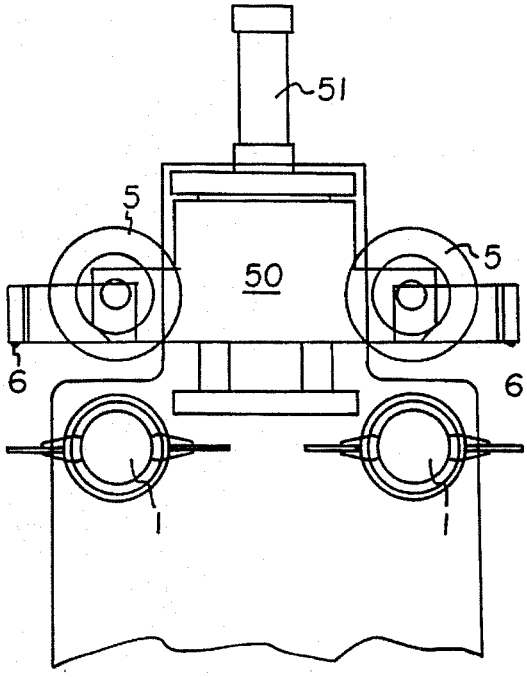
FIG. 3 shows the front view of the apparatus of FIG. 2A in standby condition.
Figure 4:
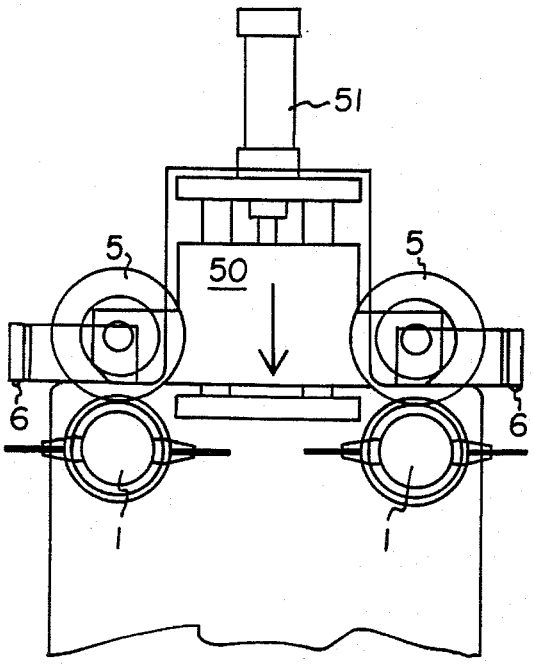
FIG. 4 shows the apparatus of FIG. 3 in operating condition.
Figure 5:
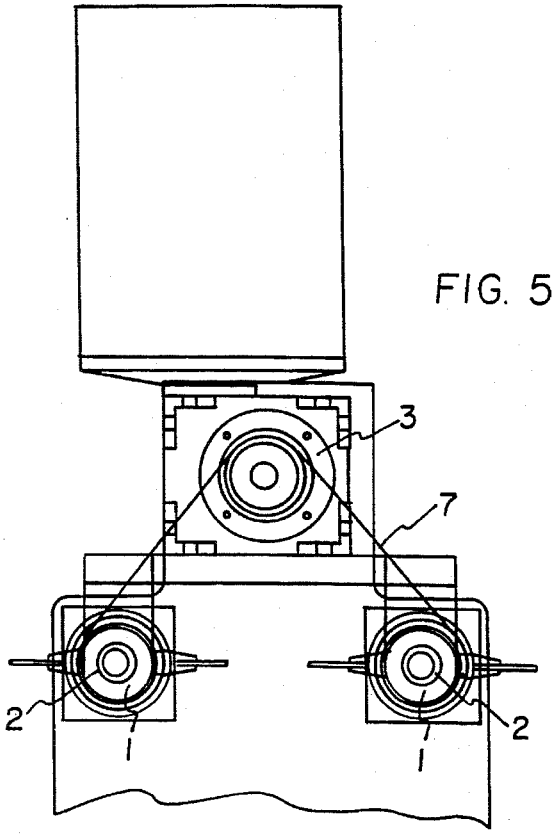
FIG. 5 shows tile detail of the driving member for moving the hosiery supports in the apparatus of FIG. 4.

Advantageously, according to the invention and with reference to FIGS. 3 and 4 of the accompanying drawings, each of the rollers 5 is mounted on a vertically sliding support 50 operated by a cylinder actuator 51 with a vertical axis.

Moreover, advantageously, each of the pads 2 is connected to the motor 3 via a belt transmission 7.

The operation of the above described apparatus, during the phase in which the stockings have already been fitted on the corresponding hosiery support 1, is as follows. Each pad 2, upon actuation by the respective cylinder 4, is moved close to the corresponding hosiery support 1 until the pad 2 is in engagement therewith, and so that the rotation of each pad 2 causes the corresponding hosiery support 1 and hose or stocking to be driven into rotation as well. At the same time, the support 50 of rollers 5 is moved down upon actuation of the actuator 51. The foot of each stocking is thereby compressed to allow the maximum adhesion thereof to the respective hosiery support 1. In this way, the foot of each stocking is made to rotate until the corresponding photocell 6 detects the respective mark. When the mark of one stocking has been detected, the relevant pad 2 is moved backwards to interrupt the transmission of motion and thus the rotation of the corresponding support 1. This enables the stocking to be disposed or arranged in the required position. When both stockings are in the required position, the cylinder 51 operates the lifting of the support 50 and, with it, of rollers 5 to release the stockings. In the thus achieved condition, the stockings are ready for the seaming of the respective toes.

The rollers 5 may also be used for retaining the stockings at the end of their axial positioning on the respective supports 1, that is, during the phase preceding the one above described.

Practically, all the construction details may vary in any equivalent way as far as the shape, dimensions, elements disposition, nature of the used materials are concerned, without nevertheless departing from the scope of the adopted solution idea and, thereby, remaining within the limits of the protection granted to the present patent for industrial invention.

What is claimed is:

1. An apparatus for positioning a tubular article, the apparatus comprising:

a hosiery support having a longitudinal support axis, said hosiery support having means for holding the tubular article on said hosiery support and said hosiery support being rotatable with the tubular article about said support axis;

a coupling means positioned substantially coaxial with said support axis for rotating said hosiery support with the tubular article positioned on said hosiery support;

detection means positioned adjacent said hosiery support for detecting when the tubular knitted article has been rotated to a predetermined position by said coupling means;

actuator means connected to said coupling means for engaging and disengaging said coupling means with said hosiery support.

2. An apparatus in accordance with claim 1, further comprising:

presser roller means positioned adjacent said hosiery support and for compressing a portion of the tubular article against said hosiery support when said coupling means is engaged with and rotating said hosiery support and the tubular article.

3. An apparatus in accordance with claim 1, wherein:

said detection means includes a photocell and a mark located on the tubular article, said photocell detects said mark as said hosiery support with the tubular article rotate and said mark passes adjacent said photocell.

4. An apparatus in accordance with claim 1, wherein:

said hosiery support includes two coaxial elements, one of said coaxial elements having a free end engagable with said coupling means, said free end being shaped to form a flaring element;

said coupling means including a pad having a shape corresponding to said flaring element for engaging with said flaring element.

5. An apparatus in accordance with claim 1, wherein:

said actuator means includes a cylinder means for moving said coupling means against and away from said hosiery support.

6. An apparatus in accordance with claim 2, wherein:

said presser roller means includes a rubber coated roller rotatable about a roller axis, said roller axis being substantially parallel with said support axis.

7. An apparatus in accordance with claim 6, wherein:

said presser roller means includes a support means for moving said rubber coated roller towards and away from said hosiery support.

8. An apparatus in accordance with claim 1, further comprising:

another hosiery support spaced from said hosiery support and similar to said hosiery support;

another coupling means similar to said coupling means;

a motor means driving both said coupling means and said another coupling means;

another detection means similar to said actuator means;

another actuator means similar to said actuator means, said actuator means and said another actuator means disconnecting said coupling means and said another coupling means from respective said hosiery supports when respective said detection means detects a respective said predetermined position of a respective tubular article.

9. An apparatus in accordance with claim 8, wherein:

said coupling means and said another coupling means are connected to said motor means by a belt transmission.

10. An apparatus in accordance with claim 8, further comprising:

presser roller means positioned adjacent said hosiery support and for compressing a portion of the tubular article against said hosiery support when said coupling means is engaged with and rotating said hosiery support and the tubular article;

another presser roller means positioned adjacent said hosiery support and similar to said hosiery support;

a support means for moving said presser roller means and said another pressor roller means towards and away from said hosiery support.

* * * * *

UNITED STATES PATENT AND TRADEMARK OFFICE

CERTIFICATE OF CORRECTION

PATENT NO. : 5,531,173

DATED : July 2, 1996

INVENTOR(S) : Pier Lorenzo MIGLIORINI

It is certified that error appears in the above-indentified patent and that said Letters Patent is hereby corrected as shown below:

Title page, item [75] correct the inventor's name to read

PIER LORENZO MIGLIORINI

Signed and Sealed this

Twenty-second Day of October, 1996

*Attest:*

Bruce Lehman

BRUCE LEHMAN

*Attesting Officer*

*Commissioner of Patents and Trademarks*